US010299337B1

(12) United States Patent
Chen et al.

(10) Patent No.: US 10,299,337 B1
(45) Date of Patent: May 21, 2019

(54) SYSTEMS TO CONTROL DIMMING OPERATIONS OF A LIGHT-EMITTING DIODE LIGHT FIXTURE USING MULTIPLE DIMMING MODES

(71) Applicant: ABL IP Holding LLC, Atlanta, GA (US)

(72) Inventors: Feng Chen, Hoffman Estates, IL (US); Towfiq M. Chowdhury, Lake Forest, IL (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/021,627

(22) Filed: Jun. 28, 2018

(51) Int. Cl.
*H05B 3/08* (2006.01)
*H05B 33/08* (2006.01)

(52) U.S. Cl.
CPC ..... *H05B 33/0866* (2013.01); *H05B 33/0824* (2013.01)

(58) Field of Classification Search
None
See application file for complete search history.

(56) References Cited

U.S. PATENT DOCUMENTS 8,228,002 B2 7/2012 Newman, Jr. et al.
8,710,754 B2 * 4/2014 Baddela ..... H05B 33/086 315/192
8,791,642 B2 7/2014 van de Ven et al.
8,872,438 B2 10/2014 Zhou et al.
9,544,951 B1 1/2017 O'Neil et al.
9,730,291 B1 * 8/2017 Janik ..... H05B 33/086
9,820,350 B2 11/2017 Pyshos et al.
2010/0141175 A1 6/2010 Hasnain et al.
2011/0058372 A1 3/2011 Lerman et al.
2013/0038222 A1 2/2013 Yeh et al.
2013/0200806 A1 8/2013 Chobot
2014/0035472 A1 2/2014 Raj et al.
2016/0363308 A1 12/2016 Shum
2016/0366746 A1 12/2016 van de Ven et al.
2017/0135186 A1 5/2017 O'Neil et al.
2017/0164440 A1 6/2017 Hu et al.

OTHER PUBLICATIONS

U.S. Appl. No. 15/991,209, "Non Final Office Action," dated Sep. 7, 2018, 10 pages.
U.S. Appl. No. 16/022,892, "Non-Final Office Action," dated Oct. 29, 2018, 6 pages.

* cited by examiner

*Primary Examiner* — Dedei K Hammond
(74) *Attorney, Agent, or Firm* — Kilpatrick Townsend & Stockton LLP

(57) ABSTRACT

Certain aspects involve lighting systems relating to control of light fixture dimming. For instance, a lighting system may include a first light source that outputs a first light color and a second light source that outputs a second light color. The lighting system also includes a switching device that couples and decouples the second light source in parallel with the first light source. The switching device includes a first setting that couples the second light source in parallel with the first light source and enables a variable color dimming operation. The switching device also includes a second setting that decouples the second light source from the first light source and enables a static color dimming operation.

20 Claims, 5 Drawing Sheets

SYSTEMS TO CONTROL DIMMING OPERATIONS OF A LIGHT-EMITTING DIODE LIGHT FIXTURE USING MULTIPLE DIMMING MODES

TECHNICAL FIELD

This disclosure relates generally to systems to control light fixture dimming operations. More specifically, but not by way of limitation, this disclosure relates to light-emitting diode light fixture systems providing control of a dimming operation using multiple dimming modes.

BACKGROUND

Light fixture dimming operations provide a mechanism for adjusting a brightness of a light output on a gradient from a bright output to a dim output. During a dimming operation, a human eye observes a light output of an incandescent bulb transition from a bright white color to a dim yellow color. Because light-emitting diodes (LEDs) do not change color temperatures with changes to brightness of the LEDs, the dimming of an LED light fixture does not provide a color temperature transition similar to the dimming of an incandescent bulb. Dimming operations of the LED light fixtures may be performed without consideration or control of a color temperature associated with the light output of the light fixture.

Existing static color dimming operations ignore the ability to alter a color temperature of a light output based on a dimming level. Because the color temperature is unchanged during the static color dimming operation, an LED light fixture equipped with a white light may generate a light output that is perceived by a human eye as unusual or unnatural during the static color dimming operation. Such a perception may be particularly evident in a residential lighting environment. Instead of creating a subdued and warm ambiance, the dimmed light fixture that includes LEDs with a white color temperature generates a dim and crisp environment.

SUMMARY

Certain aspects involve lighting systems in which the color temperature of the illumination can be selectively modified. For instance, a lighting system may include a first light source that outputs a first light color and a second light source that outputs a second light color. The lighting system also includes a switching device that couples and decouples the second light source in parallel with the first light source. The switching device includes a first setting that couples the second light source in parallel with the first light source and enables a variable color dimming operation. The switching device also includes a second setting that decouples the second light source from the first light source and enables a static color dimming operation.

In one or more additional examples, a lighting system includes a first light source that emits light at a first color and a second light source that emits light at a second color different from the first color. The lighting system also includes a controller that controls application of current across a conductive path associated with the second light source based on a magnitude of current output from a driver toward the first light source and the second light source. Further, the lighting system includes a switching device having a first configuration connecting the second light source in parallel with the first light source and a second configuration removing the second light source from the conductive path associated with the second light source.

In one or more additional examples, a method includes emitting a first light output of a first light source at a first color. Additionally, the method includes adding a second light source in parallel with the first light source and emitting a second light output of the second light source at a second color different from the first color. Further, the method includes performing a variable color dimming operation on a combined light output of the first light source and the second light source.

These illustrative aspects are mentioned not to limit or define the disclosure, but to provide examples to aid understanding thereof. Additional aspects are discussed in the Detailed Description, and further description is provided there.

BRIEF DESCRIPTION OF THE DRAWINGS

Features, aspects, and advantages of the present disclosure are better understood when the following Detailed Description is read with reference to the accompanying drawings.

DETAILED DESCRIPTION

The present disclosure relates to systems that control dimming operations of a light-emitting diode (LED) light fixture using multiple dimming modes. As explained above, dimming operations of LED light fixtures generally ignore a color temperature of the light output of the LED light fixture during dimming operations. As a result, the light output maintains a single color temperature throughout the dimming operation. Certain aspects described herein improve the performance of the dimming operations of LED light fixtures. For example, certain aspects involve a mechanism that can switch between a variable color dimming operation or a static color dimming operation. Selecting between the variable color dimming operation or the static color dimming operation provides the option of increasing yellow or amber colored light or maintaining a white colored light as the LED light fixture dims.

To provide a mechanism that enables the switching between color dimming operations, multiple LED strings of varying colors may be positioned within the LED light fixture. In an example, one or more yellow, amber, or other colored LED strings are activated during the dimming operation to provide a warm dim effect to the LED light fixture as a light output dims. A switch in communication with the LED light fixture may enable the activation of the warm dim effect in the LED light fixture. For example, the switch in one position maintains a single light output color while the LED light fixture dims, and the switch in another position provides a dynamic light output color that varies while the LED light fixture dims.

Figure 1:
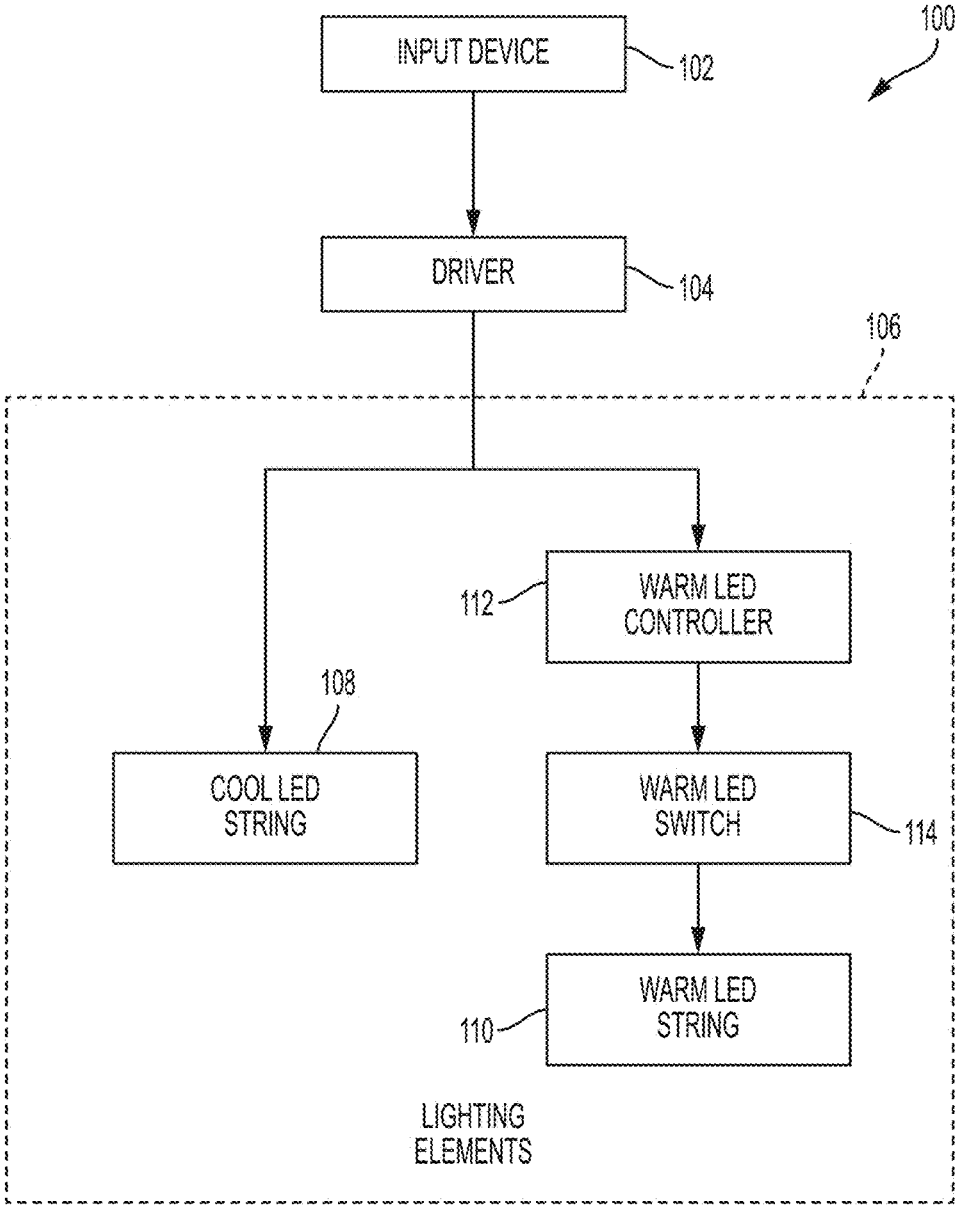
FIG. 1 depicts a block diagram of an example of a multiple dimming mode light system, according to certain aspects of the present disclosure.

FIG. 1 is a block diagram depicting a multiple dimming mode light system 100. The illustrated light system 100 includes an input device 102, a driver 104, and a lighting device 106. In an example, the input device 102 is a dimmer switch that controls light intensity of the lighting device 106 based on user input. The lighting device 106 may be illuminated using groups of LEDs (e.g., strings of LEDs). For example, the lighting device 106 may include one or more cool LED groups 108 and one or more warm LED groups 110. While the present disclosure describes groups of LEDs performing the illumination of the lighting device 106, other lighting devices may be used in place of the groups of LEDs. For example, the cool LED groups 108 and the warm LED groups 110 may be replaced with one or more organic LEDs (OLEDs), one or more laser diodes, or one or more of any other light sources.

The driver 104 may provide a current source to the lighting device 106. The amount of current provided to the lighting device 106 may vary based on an input provided by the input device 102 (e.g., a dimming switch). For example, less current is provided to the lighting device 106 if the input device 102 is set to a dim setting, and more current is provided to the lighting device 106 if the input device 102 is set to a bright setting. Examples of the input device 102 may include a dimmer bar, a dimmer wheel, a dimmer button, a dimmer with wireless communication capabilities, or any other device that is capable of controlling the driver 104 to reduce an amount of current provided to the lighting device 106.

The lighting device 106 may include the cool LED group 108. The cool LED group 108 may provide a light output at a static light output color. In one example, the static light output color of the cool LED group 108 is a white light or a near white light. Because the cool LED group 108 is a group of LEDs, the light output color of the cool LED group 108 remains constant as the intensity of the light output increases and decreases. The light output color of the cool LED group 108 may be desirable for certain tasks using a relatively bright light output, such as in a kitchen or a workspace.

The lighting device 106 may also include the warm LED group 110. The warm LED group 110 may provide a light output at an additional static light output color. In one example, the static light output color of the warm LED group 110 is a yellow or amber light. The light output color of the warm LED group 110 may be desirable at relatively dim light outputs. The outputs of the cool LED group 108 and the warm LED group 110 combine to provide an overall light output of the lighting device 106.

To generate the light output of the lighting device 106 with a variable color during a dimming operation, a warm LED controller 112 may control current applied to the warm LED group 110. For example, if the input device 102 requests a bright light output, the warm LED controller 112 may limit or stop application of current to the warm LED group 110. As the input device 102 requests a dimmer light output, the warm LED controller 112 may increase an amount of current provided to the warm LED group 110 while the current provided to the cool LED group 108 decreases. The resulting overall light output of the lighting device 106 is a light output that transitions from a bright white color at full brightness to a yellow or amber color as the light output of the lighting device 106 dims.

The lighting device 106 may also include a warm LED switch 114. The warm LED switch 114 (e.g., an output configuration switch) may be a switching device that includes a setting to prevent provision of current to the warm LED group 110 regardless of an input provided by the input device 102 to the driver 104. In such a setting, the dimming operation of the lighting device 106 may be referred to as a static color dimming operation. The output of the lighting device 106 remains a color of the cool LED group 108 (e.g., a white or near white light) during the entire dimming operation. In another setting of the warm LED switch 114, the warm LED switch 114 enables provision of current to the warm LED group 110 based on an amount of current provided to the lighting device 106 by the driver 104 (e.g., based on an input by the input device 102). If the warm LED switch 114 is in such a setting, the dimming operation of the lighting device 106 may be referred to as a dynamic color dimming operation. The output color of the lighting device 106 changes as the lighting device 106 experiences the dynamic color dimming operation.

Examples of the warm LED switch 114 may include a mechanical switch, an electro-mechanical switch, a wireless switch, a solid-state switch, a transistor, or any other switch capable of changing a conductive path associated with the warm LED group 110. By using a mechanism to couple or decouple the conductive path associated with the warm LED group 110, the lighting device 106 can provide a user with the ability to transition between the static color dimming operation and the dynamic color dimming operation. The static color dimming operation may, for example, provide a crisp light output color even at lower intensity light outputs. In an example, such a light output may be used as for task lighting at a lower intensity. Additionally, the dynamic color dimming operation may provide a warm dimming approach to decreasing the intensity of the lighting device 106. In an example, the warm dimming approach is used to provide natural or ambient lighting to an area at a lower light output intensity. By providing the warm LED switch 114 to the lighting device 106, dim light output is available for both task lighting and ambient lighting in the same lighting device 106. For example, a lamp or a light fixture including the lighting device 106 is capable of performing both the static color dimming operation and the dynamic color dimming operation.

Figure 2:
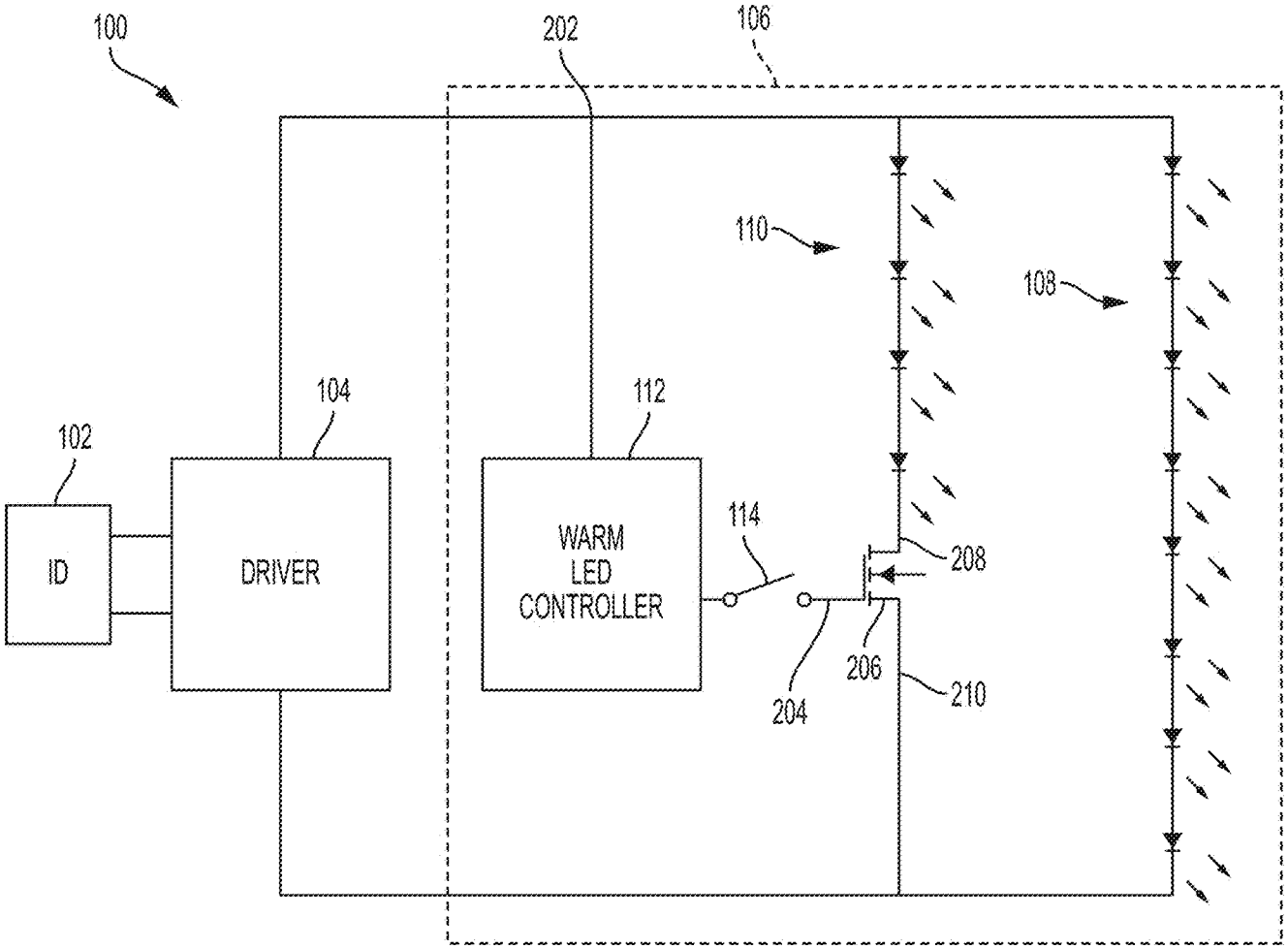
FIG. 2 depicts a schematic diagram of an example of the multiple dimming mode light system of FIG. 1, according to certain aspects of the present disclosure.

FIG. 2 is a schematic diagram of an example of the multiple dimming mode light fixture 100. As discussed above with respect to FIG. 1, the input device 102 provides signals to the driver 104 to increase or decrease current supplied to the lighting device 106. In an example, the warm LED controller 112 includes a current meter that monitors a magnitude of current supplied by the driver 104 at a node 202, which is positioned between the driver 104 and the cool LED group 108 and the warm LED group 110.

Figure 3:
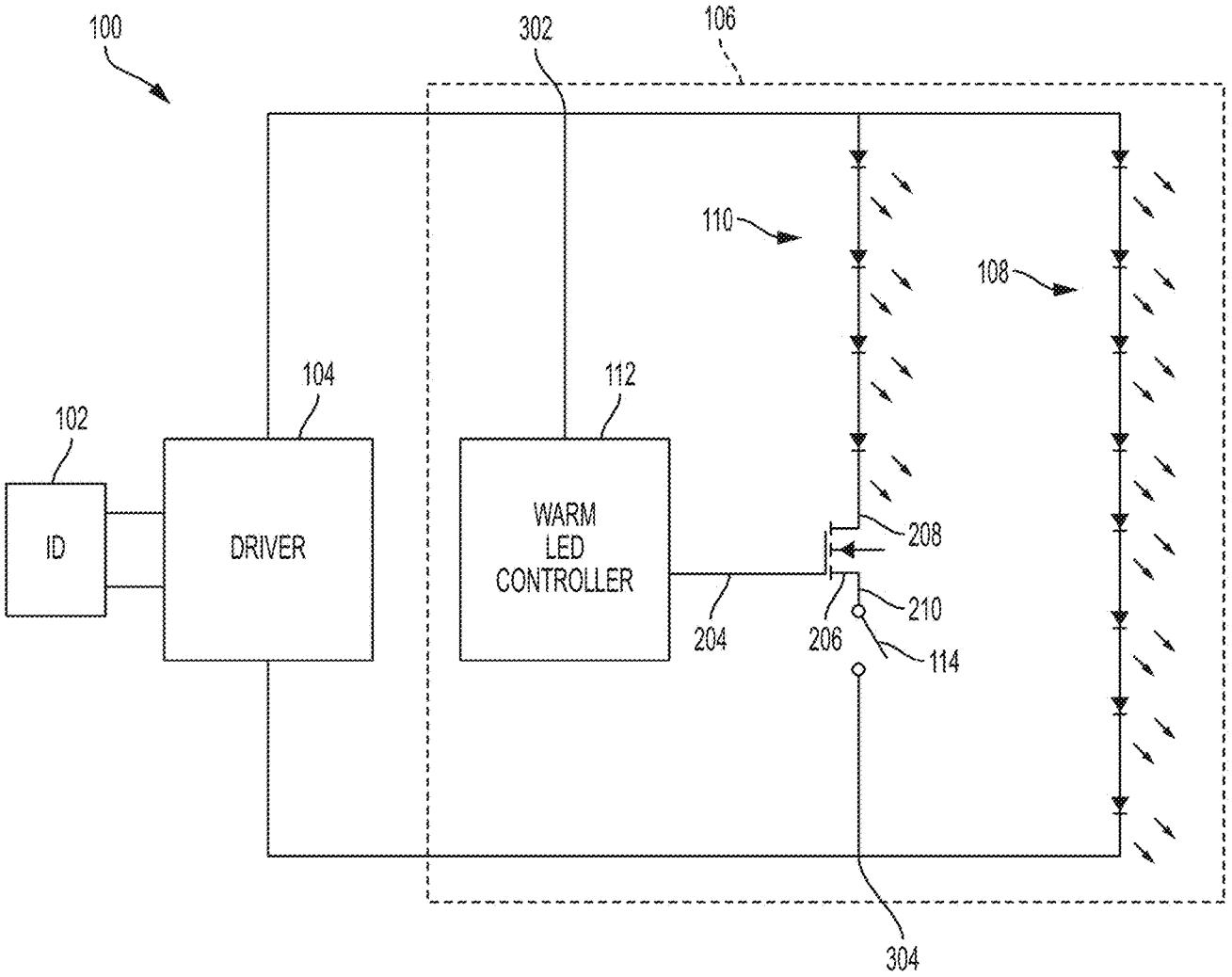
FIG. 3 depicts a schematic diagram of an additional example of the multiple dimming mode light system of FIG. 1, according to certain aspects of the present disclosure.
Figure 4:
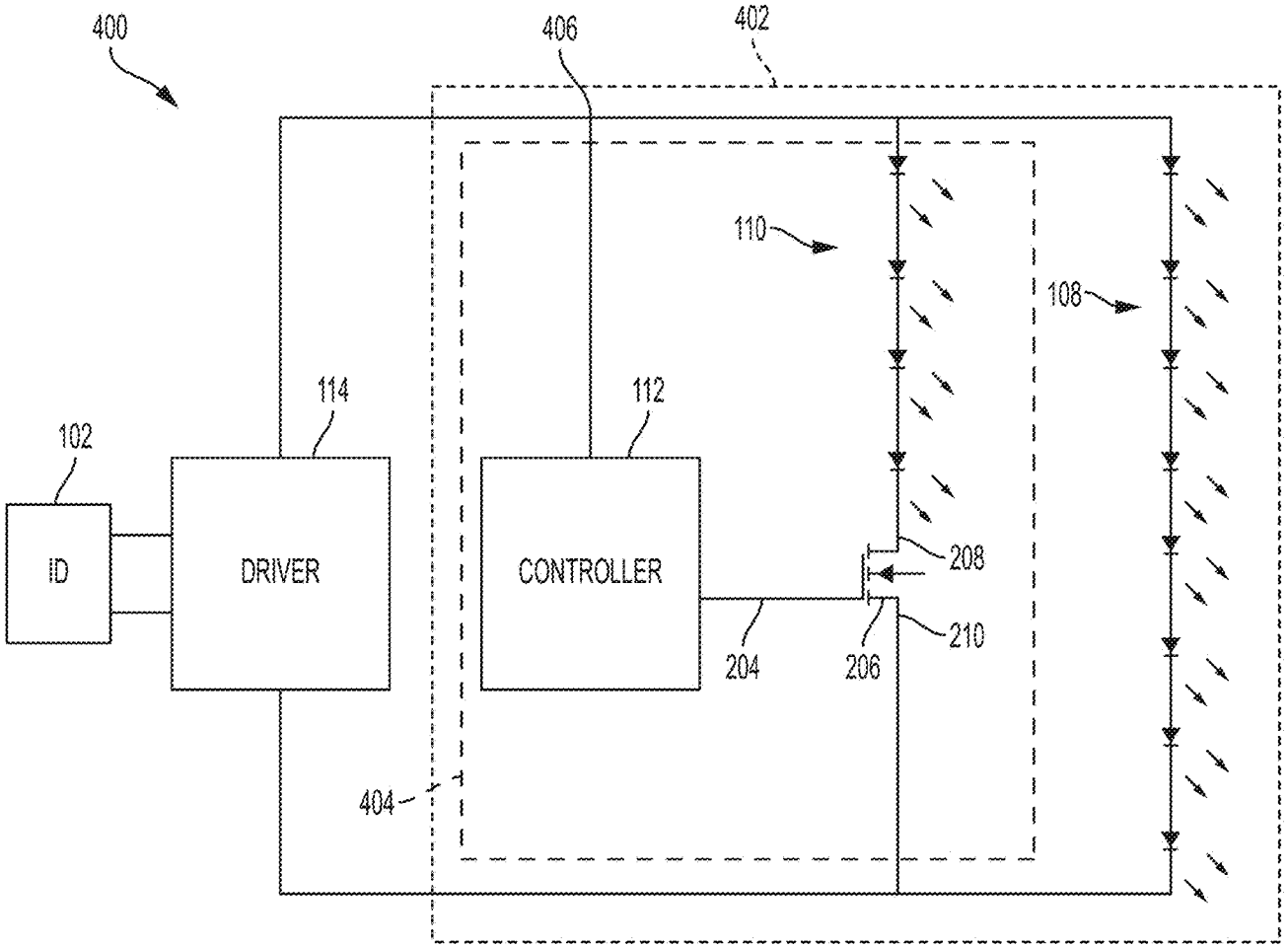
FIG. 4 depicts a schematic diagram of an example of a warm dimming mode light fixture, according to certain aspects of the present disclosure.

By measuring the current at the node 202, the warm LED controller 112 outputs a voltage to a gate 204 of a transistor 206 (e.g., a field-effect transistor (FET), a metal-oxide-semiconductor field-effect transistor (MOSFET), a bipolar junction transistor, or any other type of transistor), which is coupled in series with the warm LED group 110, if the warm LED switch 114 is closed. As discussed above with reference to FIG. 1, the warm LED switch 114 is closed if a variable color dimming operation is desired. A pulse width modulated (PWM) voltage signal provided by the warm LED controller 112 to the gate 204 may vary based on the current detected at the node 202. For example, as the current at the node 202 decreases, a duty cycle of the PWM voltage signal provided to the gate 204 may increase. Likewise, as the current at the node 202 increases, the duty cycle of the PWM voltage signal provided to the gate 204 may decrease. While the transistor 206 is depicted in FIGS. 2-4 as a mechanism to control current across the warm LED group 110, any other device or component capable of controlling current across the warm LED group 110 is also contemplated. For example, the transistor 206 may be replaced by a any electronic switching device capable of controlling the current across the warm LED group 110.

The voltage provided to the gate 204 of the transistor 206 increases conductivity between a source 208 and a drain 210 of the transistor 206. Accordingly, as the duty cycle of the PWM voltage signal provided to the gate 204 increases, less overall resistance is present between the source 208 and the drain 210. In this manner, a greater duty cycle of the PWM voltage signal at the gate 204 results in a greater overall conductivity across the transistor 206, an increase in the current provided to the warm LED group 110, and a brighter output of the warm LED group 110. If the warm LED controller 112 provides a voltage less than a gate threshold voltage to the gate 204, or if the warm LED switch 114 is open, the conductivity between the source 208 and the drain 210 of the transistor 206 is negligible, and the warm LED group 110 does not emit a light output as no current flows across the warm LED group 110.

FIG. 3 is a schematic diagram of another example of the multiple dimming mode light fixture 100. As discussed above with respect to FIG. 1, the input device 102 provides signals to the driver 104 to increase or decrease current supplied to the lighting device 106. In an example, the warm LED controller 112 includes a current meter that detects the current supplied by the driver 104 at a node 302, which is positioned between the driver 104 and the cool LED group 108 and the warm LED group 110.

Based on the current measured at the node 302, the warm LED controller 112 outputs a PWM voltage signal to the gate 204 of the transistor 206. The duty cycle of the PWM voltage signal provided by the warm LED controller 112 to the gate 204 may vary based on the current detected at the node 302. For example, as the current at the node 302 decreases, the duty cycle of the PWM voltage signal provided to the gate 204 may increase. Likewise, as the current at the node 302 increases, the duty cycle of the PWM voltage signal provided to the gate 204 may decrease.

The voltage provided to the gate 204 of the transistor 206 increases conductivity between the source 208 and the drain 210 of the transistor 206. Accordingly, as the duty cycle of the PWM voltage signal provided to the gate 204 increases, less overall resistance is present between the source 208 and the drain 210. In this manner, a greater duty cycle of the PWM voltage signal at the gate 204 results in a greater overall conductivity across the transistor 206, an increase in current provided to the warm LED group 110, and a brighter output of the warm LED group 110. However, if the warm LED controller 112 provides a voltage less than a gate threshold voltage to the gate 204 the conductivity between the source 208 and the drain 210 of the transistor 206 is negligible, and the warm LED group 110 does not emit a light output. Further, if the warm LED switch 114 is open, current is not provided to the warm LED group 110 regardless of the voltage supplied by the warm LED controller 112 to the gate 204 of the transistor 206.

While the warm LED switch 114 is described in FIGS. 2 and 3 as being placed at the gate 204 of the transistor 206 or between the transistor 206 and a node 304, other positions of the warm LED switch 114 are also contemplated. For example, the warm LED switch 114 may be positioned between the node 302 and the warm LED controller 112, between the node 302 and the warm LED group 110, between individual LEDs of the warm LED group 110, between the warm LED group 110 and the transistor 206, or at any other location where the warm LED switch 114 is able to override control voltage signals provided by the warm LED controller 112 to the gate 204 of the transistor 206 or to override sensing signals provided to the warm LED controller 112.

Turning to FIG. 4, a schematic diagram of an example of a warm dimming mode light fixture 400 is depicted. As discussed above with respect to FIG. 1, the input device 102 provides signals to the driver 104 to increase or decrease current supplied to a lighting device 402. As illustrated, a warm LED device 404 may be added in parallel to the cool LED group 108. The warm LED device 404 may include the warm LED controller 112, the transistor 206, and the warm LED group 110. In an example, a previously assembled or manufactured lighting device including a group of LEDs with only one light output color (e.g., the cool LED group 108) may be retrofitted with the warm LED device 404 to form the warm dimming mode light fixture 400.

In an example, the warm LED device 404 includes the warm LED controller 112. The warm LED controller 112 may include a current meter that detects the current supplied by the driver 104 at a node 406, which is positioned between the driver 104 and the cool LED group 108 and the warm LED group 110 if the warm LED device 404 is coupled in parallel with the cool LED group 108. Based on the current measured at the node 406, the warm LED controller 112 outputs a PWM voltage signal to the gate 204 of the transistor 206. A duty cycle of the PWM voltage signal provided by the warm LED controller 112 to the gate 204 may vary based on the current detected at the node 406. For example, as the current at the node 406 decreases, the duty cycle of the PWM voltage signal provided to the gate 204 may increase. Likewise, as the current at the node 406 increases, the duty cycle of the PWM voltage signal provided to the gate 204 may decrease.

The voltage provided to the gate 204 of the transistor 206 results in an increase in conductivity between the source 208 and the drain 210 of the transistor 206. Accordingly, as the duty cycle of the PWM voltage signal provided to the gate 204 increases, less resistance is present between the source 208 and the drain 210. In this manner, a duty cycle of the PWM voltage signal at the gate 204 results in a greater conductivity across the transistor 206 resulting in a greater flow of current through the warm LED group 110 and a brighter light output of the warm LED group 110. However, if the warm LED controller 112 provides a voltage less than a gate threshold voltage to the gate 204, the conductivity between the source 208 and the drain 210 of the transistor 206 is negligible, and the warm LED group 110 does not emit a light output.

While the warm LED device 404 is depicted without the warm LED switch 114, the warm LED switch 114 may also be included in one or more examples of the warm LED device 404. Accordingly, the warm LED device 404 with the warm LED switch 114 may be provided in parallel with a cool LED group 108 to switch between a variable color dimming operation and a static color dimming operation.

Figure 5:
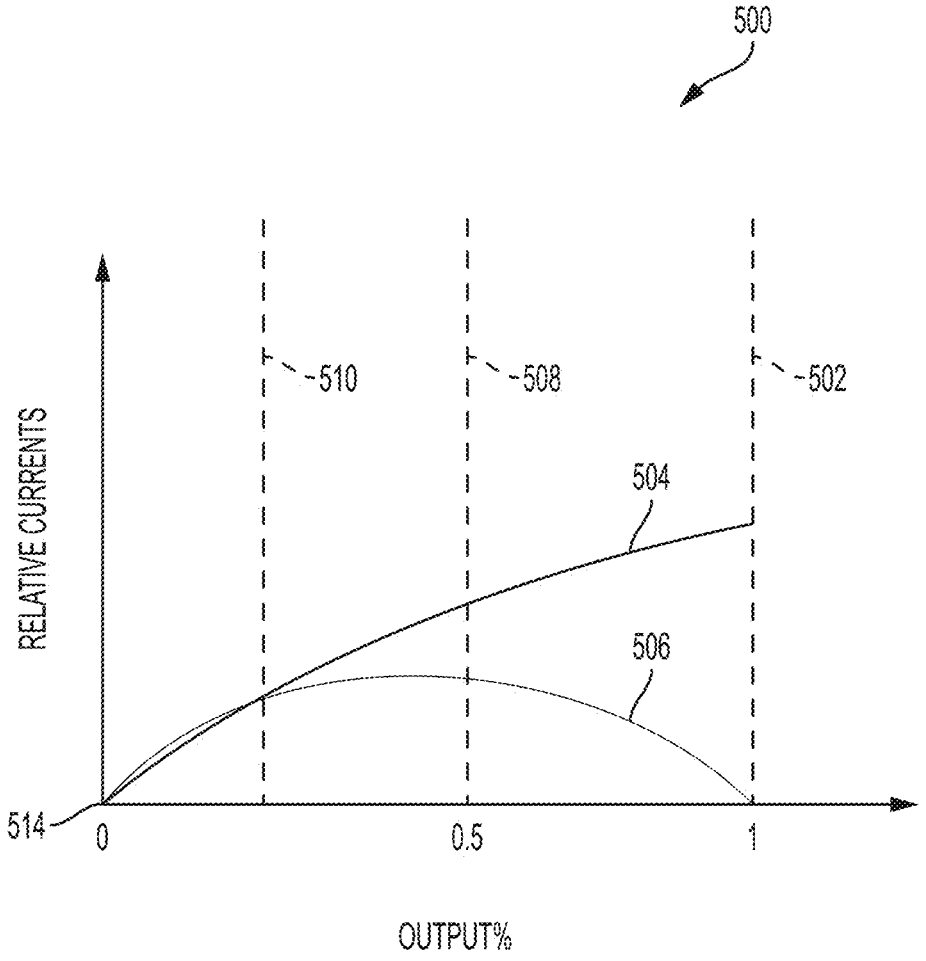
FIG. 5 depicts graphical representation of electric currents provided to light-emitting diode groups during a variable color dimming operation over a range of dimming percentages, according to certain aspects of the present disclosure.

FIG. 5 is graphical representation 500 of electric currents provided during a variable color dimming operation over a range of output lighting percentages of a light fixture 100 or 400. As can be seen at point 502, which represents full power provided to lighting elements of the light fixture 100 or 400, a current 504 provided to the cool LED group 108 is at a maximum value, and a current 506 provided to the warm LED group 110 is at a minimum value. At the point 502, the warm LED controller 112 is not providing a positive voltage to the gate 204 of the transistor 206.

As the output lighting percentage decreases to point 508 on the graphical representation 500, the warm LED controller 112 can detect a change in the current provided to the lighting device 106 of the light fixture 100 or 400. For example, at point 508, the current provided to the lighting device 106 may be approximately 50% of the current provided to the lighting device 106 at point 502. In response to a decrease in the current provided to the lighting device 106, the warm LED controller 112 may begin to apply a positive voltage to the gate 204 of the transistor 206. As the current provided to the lighting device 106 decreases, a duty cycle of the PWM voltage signal applied to the gate 204 increases such that additional current 506 flows through the warm LED group 110 while less current 504 flows through the cool LED group 108. Due to the parallel path between the cool LED group 108 and the warm LED group 110, any increase in the current 506 provided to the warm LED group 110 results in a decrease in the current 504 provided to the cool LED group 110.

As the light output percentage reaches point 510, the current 504 provided to the cool LED group 108 and the current 506 provided to the warm LED group 110 may reach an equilibrium. That is, the same amount of current may be provided to the two parallel paths to the cool LED group 108 and the warm LED group 110. Upon reaching the equilibrium, the currents 504 and 506 continue to decrease toward point 514 where the lighting device 106 is no longer providing a light output.

As illustrated in the graphical representation 500, the warm LED controller 112 may enable the lighting device 106 to simulate a light color output of an incandescent lightbulb during a dimming operation. For example, the currents 504 and 506 provided to the cool LED group 108 and the warm LED group 110, respectively, provide a white light output at 100% output intensity and gradually transition the color of the light output to a yellow or amber light as the output intensity decreases. Additionally, if the warm LED switch 114 is set to the static color dimming operation, all of the current provided to the warm LED group 110 during the dynamic color dimming operation depicted in FIG. 5 remains with the cool LED group 108 throughout the course of the static color dimming operation.

General Considerations

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provide a result conditioned on one or more inputs. Suitable computing devices include multi-purpose microprocessor-based computer systems accessing stored software that programs or configures the computing system from a general purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

Aspects of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific aspects thereof, it will be appreciated that those skilled in the art, upon attaining an understanding of the foregoing, may readily produce alterations to, variations of, and equivalents to such aspects. Accordingly, it should be understood that the present disclosure has been presented for purposes of example rather than limitation, and does not preclude the inclusion of such modifications, variations, and/or additions to the present subject matter as would be readily apparent to one of ordinary skill in the art.

The invention claimed is:

1. A lighting system, comprising:

a first light source configured to output a first light color;

a second light source configured to output a second light color;

a switching device configured to couple and decouple the second light source in parallel with the first light source, wherein the switching device comprises:

a first setting configured to (i) couple the second light source in parallel with the first light source and (ii) enable a variable color dimming operation; and a second setting configured to (i) decouple the second light source from the first light source and (ii) enable a static color dimming operation; and a light source controller configured to (i) monitor a magnitude of the current provided by a driver to the first light source and the second light source and (ii) control, based on the monitored magnitude of the current provided by the driver, application of the current to the second light source using an additional switching device.

2. The lighting system of claim 1, further comprising:

the driver configured to provide the current to the first light source and the second light source.

3. The lighting system of claim 1, further comprising:

the additional switching device comprising a transistor coupled in series with the second light source, wherein the light source controller controls a current magnitude flowing across the second light source by adjusting a duty cycle of a pulse width modulated voltage signal supplied to a gate of the transistor.

4. The lighting system of claim 1, wherein the variable color dimming operation comprises providing current to the second light source when the variable color dimming operation begins.

5. The lighting system of claim 1, wherein the static color dimming operation comprises preventing provision of current to the second light source when the static color dimming operation begins.

6. The lighting system of claim 1, wherein the first light source comprises a first light-emitting diode group configured to output the first light color, and the second light source comprises a second light-emitting diode group configured to output the second light color.

7. The lighting system of claim 1, wherein the switching device comprises at least one of a mechanical switch, an electro-mechanical switch, a wireless switch, a solid-state switch, or a transistor.

8. The lighting system of claim 1, wherein the first light color comprises a white color, and the second light color comprises a yellow color.

9. A lighting system, comprising:

a first light source configured for emitting light at a first color;

a second light source configured for emitting light at a second color different from the first color;

a controller configured to control, using a first switching device, application of current across a conductive path associated with the second light source based on a magnitude of current output from a driver toward the first light source and the second light source; and a second switching device having (i) a first configuration connecting the second light source in parallel with the first light source and (ii) a second configuration removing the second light source from the conductive path associated with the second light source.

10. The lighting system of claim 9, wherein the first switching device comprises a transistor coupled in series with the second light source, wherein the controller controls a current magnitude flowing across the second light source by adjusting a voltage signal supplied to a gate of the transistor.

11. The lighting system of claim 10, wherein the controller increases a duty cycle of the voltage signal supplied to the gate of the transistor as the magnitude of the current output from the driver decreases.

12. The lighting system of claim 9, wherein the second switching device comprises at least one of a mechanical switch, an electro-mechanical switch, a wireless switch, a solid-state switch, or a transistor.

13. The lighting system of claim 9, wherein the first color comprises a white color, and the second color comprises a yellow color.

14. The lighting system of claim 9, wherein the first configuration enables a variable color dimming operation, and the second configuration enables a static color dimming operation.

15. The lighting system of claim 9, further comprising:

the driver configured to output the current toward the first light source and the second light source; and a dimming switch configured to control a dimming operation of the first light source and the second light source by controlling the magnitude of the current output from the driver.

16. The lighting system of claim 9, wherein the first configuration of the second switching device sets a dimming operation of the first and second light sources to a variable color dimming operation, and the second configuration of the second switching device sets the dimming operation to a static color dimming operation.

17. The lighting system of claim 16, wherein the variable color dimming operation comprises transitioning a combined light output of the first light source and the second light source from the first color to the second color as the magnitude of the current output from the driver decreases, and the static color dimming operation comprises maintaining the combined light output at the first color as the magnitude of the current output from the driver decreases.

18. A method, comprising:

emitting a first light output of a first light source at a first color;

switching an output configuration switch to a variable color dimming mode to add a second light source in parallel with the first light source;

emitting a second light output of the second light source at a second color different from the first color; and controlling a switching device during a variable color dimming operation on a combined light output of the first light source and the second light source to control the second light output of the second light source.

19. The method of claim 18, wherein adding the second light source in parallel with the first light source comprises:

moving the output configuration switch from (i) a static color dimming mode that sets a dimming operation to a static color dimming operation to (ii) the variable color dimming mode that sets the dimming operation to the variable color dimming operation.

20. The method of claim 18, wherein adding the second light source in parallel with the first light source comprises:

installing the second light source in parallel with the first light source, wherein the first light source is positioned within a previously assembled lighting device.

* * * * *